US008882612B2

(12) United States Patent
Pinezich et al.

(10) Patent No.: US 8,882,612 B2
(45) Date of Patent: Nov. 11, 2014

(54) SOCCER PASSING TRAINER APPARATUS AND GAMES

(76) Inventors: John D. Pinezich, Northport, NY (US); Kingsley James Cox, Stony Brook, NY (US)

( * ) Notice: Subject to any disclaimer, the term of this patent is extended or adjusted under 35 U.S.C. 154(b) by 0 days.

(21) Appl. No.: 13/530,105

(22) Filed: Jun. 21, 2012

(65) Prior Publication Data

US 2012/0329584 A1 Dec. 27, 2012

Related U.S. Application Data

(60) Provisional application No. 61/571,144, filed on Jun. 22, 2011.

(51) Int. Cl.

| | |
|---|---|
| ***A63B 69/00*** | (2006.01) |
| ***A63B 67/00*** | (2006.01) |
| ***A63B 63/00*** | (2006.01) |
| *A63B 71/02* | (2006.01) |

(52) U.S. Cl.

CPC ..... *A63B 63/007* (2013.01); *A63B 63/004* (2013.01); *A63B 2243/0025* (2013.01); *A63B 69/002* (2013.01); *A63B 2071/026* (2013.01)

USPC ..... 473/446; 473/422; 473/471

(58) Field of Classification Search

CPC ..... A63B 69/002; A63B 224/0025; A63B 63/00433

USPC ..... 473/415, 422, 446, 454, 471, 478, 438

See application file for complete search history.

(56) References Cited

U.S. PATENT DOCUMENTS

| | | | | | |
|---|---|---|---|---|---|
| 1,933,159 | A | * | 10/1933 | Butler | 473/478 |
| 4,497,492 | A | * | 2/1985 | Lehman et al. | 473/470 |
| 4,569,515 | A | * | 2/1986 | Gordon | 473/473 |
| 4,758,002 | A | * | 7/1988 | Murphy | 473/468 |
| 5,112,061 | A | * | 5/1992 | Lamle | 473/473 |
| 5,259,625 | A | * | 11/1993 | Fanning | 473/473 |
| 5,503,402 | A | | 4/1996 | Moss, Jr. | |
| 5,533,735 | A | * | 7/1996 | Denney | 473/470 |
| 5,549,304 | A | | 8/1996 | Davis | |
| 5,556,104 | A | | 9/1996 | Guillen, Jr. | |
| 5,584,481 | A | * | 12/1996 | Caluori et al. | 473/446 |
| 5,628,515 | A | | 5/1997 | Levy | |
| 5,669,833 | A | | 9/1997 | Stone | |
| 5,722,446 | A | * | 3/1998 | Zheng | 273/402 |
| 5,741,194 | A | * | 4/1998 | Simunek | 473/490 |
| 5,961,403 | A | | 10/1999 | Caruso | |

(Continued)

FOREIGN PATENT DOCUMENTS

| | | | | |
|---|---|---|---|---|
| WO | WO 03057325 A1 | * | 7/2003 | A63B 67/02 |

*Primary Examiner* — Mitra Aryanpour

(57) ABSTRACT

We disclose an apparatus for improving passing skills in soccer, consisting of one or more triangles that can be placed on the ground to demarcate regions and boundaries on a playing field within which player movement is constrained or otherwise guided. The triangle edges are made from a flexible or extensible material and are attached at the triangle vertices by some type of joining device. The triangles can be placed on any surface suitable for soccer and held in place with stakes or other means. Multiple triangles can be placed on the ground to create a variety of demarcated regions and boundaries. This apparatus can be used for basic practice or to play various skill-enhancing games in which the ball is passed into and out of, or between, a triangle or a set of triangles.

5 Claims, 7 Drawing Sheets

(56) References Cited

U.S. PATENT DOCUMENTS

| | | | | |
|---|---|---|---|---|
| 6,241,251 | B1 * | 6/2001 | Trifonov | 273/339 |
| 6,569,041 | B1 * | 5/2003 | Riivald | 473/446 |
| 6,669,583 | B1 * | 12/2003 | Deppen | 473/474 |
| 6,918,845 | B2 * | 7/2005 | Kudla | 473/478 |
| 7,001,288 | B2 * | 2/2006 | Harrell | 473/446 |
| D533,240 | S * | 12/2006 | Sovay | D21/717 |
| 7,160,214 | B1 * | 1/2007 | Rome | 473/454 |
| 7,448,968 | B1 * | 11/2008 | Petion | 473/446 |
| 7,608,000 | B2 * | 10/2009 | Butler | 473/415 |
| 7,896,758 | B2 * | 3/2011 | Luby et al. | 473/446 |
| 8,016,290 | B1 * | 9/2011 | Rhodes | 273/317 |
| 8,128,518 | B1 * | 3/2012 | Kudla et al. | 473/478 |
| D656,995 | S * | 4/2012 | Otey et al. | D21/300 |
| 8,157,676 | B2 * | 4/2012 | Cobham | 473/446 |
| 8,506,370 | B2 * | 8/2013 | Homsi | 463/2 |
| 2002/0032084 | A1 * | 3/2002 | Hammett | 473/446 |
| 2003/0228942 | A1 * | 12/2003 | Hsieh | 473/446 |
| 2004/0266563 | A1 * | 12/2004 | Young | 473/446 |
| 2005/0192125 | A1 * | 9/2005 | Valliquette | 473/446 |
| 2006/0068946 | A1 * | 3/2006 | Harrell et al. | 473/446 |
| 2009/0069123 | A1 * | 3/2009 | Nugent | 473/422 |
| 2010/0331123 | A1 * | 12/2010 | Cobham | 473/446 |
| 2012/0329584 | A1 * | 12/2012 | Pinezich et al. | 473/446 |

* cited by examiner

SOCCER PASSING TRAINER APPARATUS AND GAMES

BACKGROUND OF THE INVENTION

1. Field of the Invention

The present invention relates to a training device and method of practice for improving skills in the sport of soccer, specifically the ability to pass the ball and to alter one's position to better receive a pass.

2. Description of the Prior Art

A variety of devices for soccer training have received patents. None of these pertain to a completely horizontal layout of the training device; hence differ fundamentally from our invention. Devices for field marking have also been examined, but these also involve vertical members and/or rectangular layouts to allow for portable fields for playing games directly related to the official rules of soccer, e.g. two teams with two goals, etc. Our device uses triangles, and the games are not directly derived from the official rules of soccer but are related to passing and player motion skill enhancements.

U.S. Pat. No. 5,556,104, September 1996, to Guillen, Jr., titled "Soccer Practice Device," is a frame with optional netting which provides a rebounding surface. U.S. Pat. No. 5,961,403, October 1999, to Anthony Caruso, titled "Training Device for Soccer" is a U-shaped wooden box that provides a number of reflecting surfaces for passing and dribbling practices. U.S. Pat. No. 5,549,304, August 1996, to Jimmy D. Davis, titled "Recreational Practice Apparatus for Soccer Players," is a frame with netting that can be arranged in various ways to provide a rebounding surface. These devices do not demarcate regions and are not entirely horizontal, and therefore are distinct from our invention.

U.S. Pat. No. 5,503,402, April 1996, to Norman R. Moss, Jr., titled "Soccer Practice Focal Device," is a device which attaches to an existing goal structure for shooting practice. U.S. Pat. No. 5,628,515, February 1996, to Carey Levy, titled "Soccer Training System," is another device which attaches to an existing goal structure for shooting practice. These training devices deal with shooting and are distinct from our invention.

U.S. Pat. No. 5,669,833, September, 1997, to David B. Stone, titled "Soccer Training System," consists of a cord attached by cones and suspended above the ground to provide a dribbling path. This device is for the purpose of improving dribbling skills, not passing, and requires suspension above the ground, therefore is distinct from our invention.

SUMMARY OF THE INVENTION

The objective of this invention is to provide a training device and method for improving passing that provides advantages not available in the prior art. Another objective is to provide a low-cost device for soccer training that is simple to manufacture and use. Another objective is to create a device that can be laid out horizontally on a field, providing demarcations for constraining player and ball motion that fulfills the purpose of improving soccer skills, in particular the ability to pass and to move into position to make a pass, and to defend against passing.

Soccer at its core is a passing game and the ability of players to accurately pass the ball, control the ball when it is received, and then move into a space where they can receive the ball unchallenged is of critical importance to achieving success in the sport. It is possible to practice the above skills on a playing field whereby for instance two players pass the ball to each other and then move into a new space to receive that ball from the other player, with possibly a defender attempting to stop them from accomplishing this by intercepting the pass. This type of practice drill is commonly done by players of all levels and ages, however, for some players, especially young ones, it is a challenging and sometimes confusing drill. Currently there is no equipment or device to standardize this sort of passing drill. Typically, cones are used to mark out regions, but these cannot be quickly arranged to precise measurements, nor do they provide edge markings between cones. Moreover, the cones are easily displaced by the ball or the players striking them, distorting the playing area for the drill.

The present device aims to address this lack of standardized equipment by creating specially demarcated spaces on the playing area that allows a drill to be done or a game to be played whereby a ball is passed to and from demarcated areas by players. The basic equipment is an arrangement of three vertices connected by three edges that form a triangle when laid flat on a playing surface. The vertices can be cones, rings, or other mechanisms for joining the edges, which can be webbing, rope, or some other extensible material. A set of stakes, weights, or of some other mechanism is used to secure the triangle vertices to the playing surface. The combination of vertices and edges provides a means for quickly arranging the triangle to precise dimensions that are repeatable by simply stretching the device out to its maximum extent, as well as providing greater resistance to displacement by the player or ball through unintentional contact.

The basic drill or game involves a ball being passed into and out of a single demarcated area such as a triangle with the aim being to successfully control the ball upon reception so that it does not leave the triangle. This basic game can be scaled up to involve many triangles with players passing a ball to each other between the triangles which may or may not be adjacent to each other. An obvious variant on the basic passing game outlined above would have a set of triangles arranged so that two players pass to each other in such a way as to avoid a third defending player and this would necessitate the passing players moving from one triangle to another to receive the ball. This sort of passing game will greatly enhance passing training by simplifying and standardizing the exercise. Coaching will be easier since passing aims such as completed passes can be compared between groups of players.

Players pass an object such as a ball to each other from triangle to triangle so that expertise in trapping and then passing the ball can be enhanced. The key is that the playing area is demarcated into regions by the triangles and players are only allowed to receive the ball in certain designated triangles but not others. This system, consisting of one or more triangles, is a device that standardizes passing training and gives structure to passing practice and facilitates training aims such as completed passes in a defined time period. The performance of the passing and ball control skills of one player or several players can be assessed in a standardized setting allowing for player comparisons.

This basic design can be easily adapted to include any number of 'attacker' and 'defender' triangles to allow for more complex passing training involving any number of players. Other configurations (disjoint triangles) and shapes (squares) are also possible. The joining tape can be mono- or bi-colored resulting in colored triangles. These can be used to identify teams, i.e. all the people inside color A (e.g. blue) triangles are on one team, inside color B (e.g. green) are on a different team. Multiple colors can be used to add a third or more teams.

Games can be developed that provide competitive scoring which emphasize various aspects of the game. This can include passing, in which players are awarded points for successful traps, passes and movement, and can be generalized to include variation involving other aspects of the game, for example: chipping, dribbling, heading and shooting.

DETAILED DESCRIPTION OF THE PREFERRED EMBODIMENT

Figure 1:
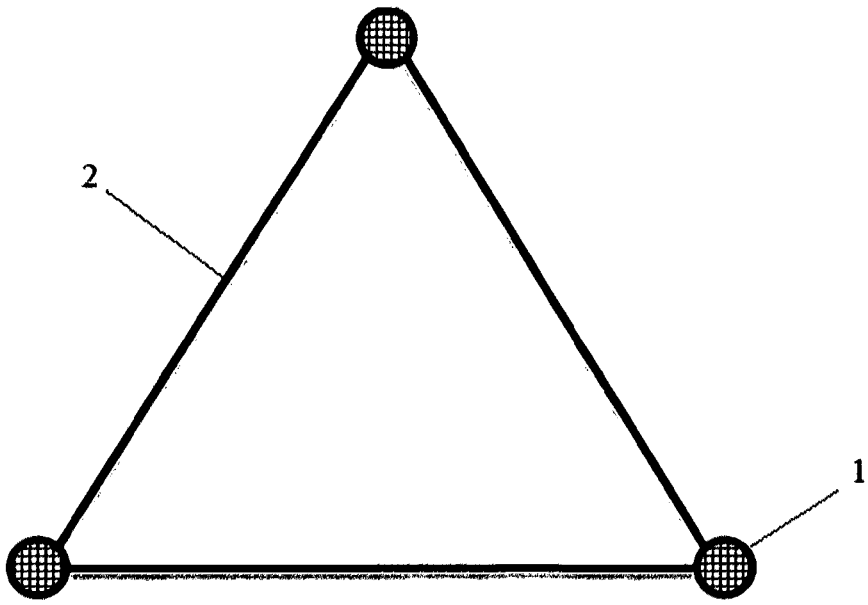
FIG. 1 is a drawing of the basic device that is used in various manners of assembly to construct training devices.

The basic device, consisting of a single triangle, is shown in FIG. 1. The triangle is laid out on the ground demarcating two regions: interior and exterior of triangle. The triangle is held in place with stakes 1 that penetrate the ground, or other means of fastening to a playing surface (e.g. a cone or ring), such as a gym floor. The stakes are linked together by a connection 2 such as webbing or rope.

Figure 2:
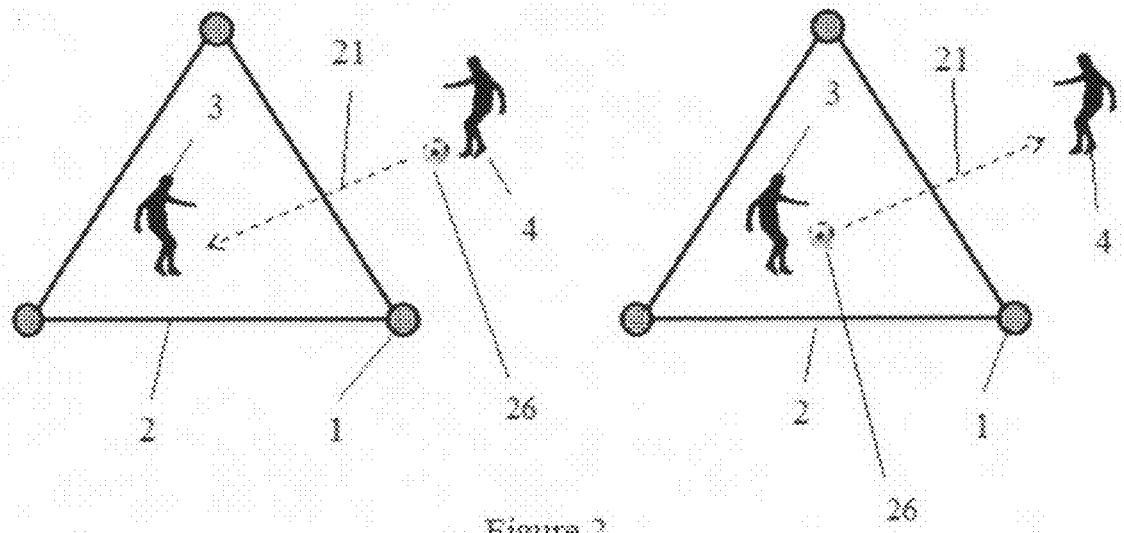
FIG. 2 shows the usage of the basic device.

The simplest instantiation of the game is shown in FIG. 2. This most basic game uses a single triangle with one player 3 in the interior of the triangle and one player 4 in the exterior of the triangle. A player in the exterior of the triangle passes a ball 26 to a player in the interior of the triangle e.g. via dashed line 21 (left panel of FIG. 2). The interior player must control the ball 26 keeping it inside the triangle. Then the interior player 3 passes the ball 26 back to the player 4 on the outside of the triangle, e.g. via dashed line 21 (right panel of FIG. 2). This is repeated with the aim of the player in the triangle receiving and controlling and then passing the ball 26, all from inside the triangle, as many times as possible in a defined period. The exterior player 4 is free to move around the triangle so that the interior player 3 must pass the ball 26 over different edges to complete the pass.

Figure 3:
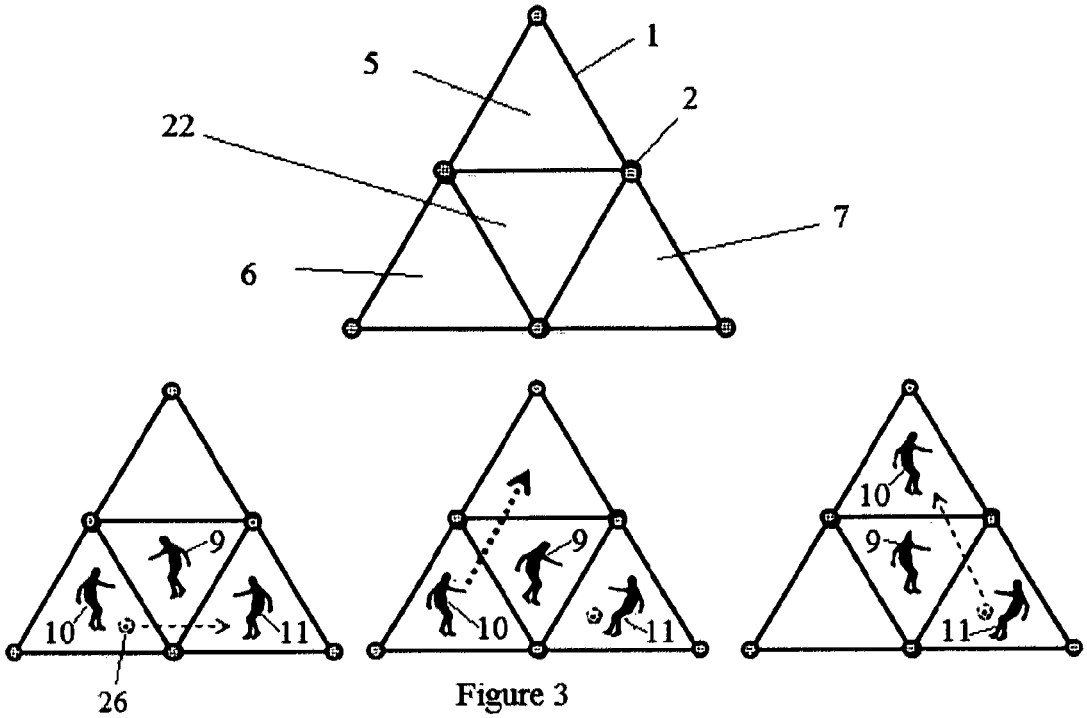
FIG. 3 shows the construction and usage of an assembly of three triangles that demarcates four triangular regions.

Another example of how the device is used is shown in FIG. 3. In this drill three basic triangles are arranged as shown, forming a fourth triangle in the middle (equivalently, six vertices are joined by 9 edges). A player 9 (defender) stands in the central triangle 22 and two other players 10 and 11 (attackers) stand in two of the three outer triangles 5, 6 and 7. The attackers attempt to pass the ball 26 to each other without the defender intercepting. In order to do this the attackers need to move from outer triangle to outer triangle in order to create room for the pass. The defender is allowed to move anywhere inside the central triangle 22 in order to attempt to intercept a pass, but is not allowed to move outside the central triangle. The attackers are only allowed in the outer triangles 5, 6, 7 and are forbidden from entering the central triangle. Two attackers are not allowed in the same outer triangle simultaneously. More specifically, one player 9 is constrained to remain in the middle triangle, two other players 10 and 11 are free to move between the outer triangles. Players 10 and 11 are on offense, player 9 is on defense. Suppose player 10 is in outer triangle 6. He attempts to pass the ball 26 to player 11, who is in outer triangle 7, while player 9 tries to intercept or deflect the pass. Player 11 can jump between outer triangles 7 and 5 attempting to become free. After the pass is completed player 10 moves to, a vacant outer triangle to receive a return pass. If the defender 9 blocks a pass he switches place with either player 10 or 11. The triangles can be of any size, but typically between 10 and 20 feet for each edge.

Figure 4:
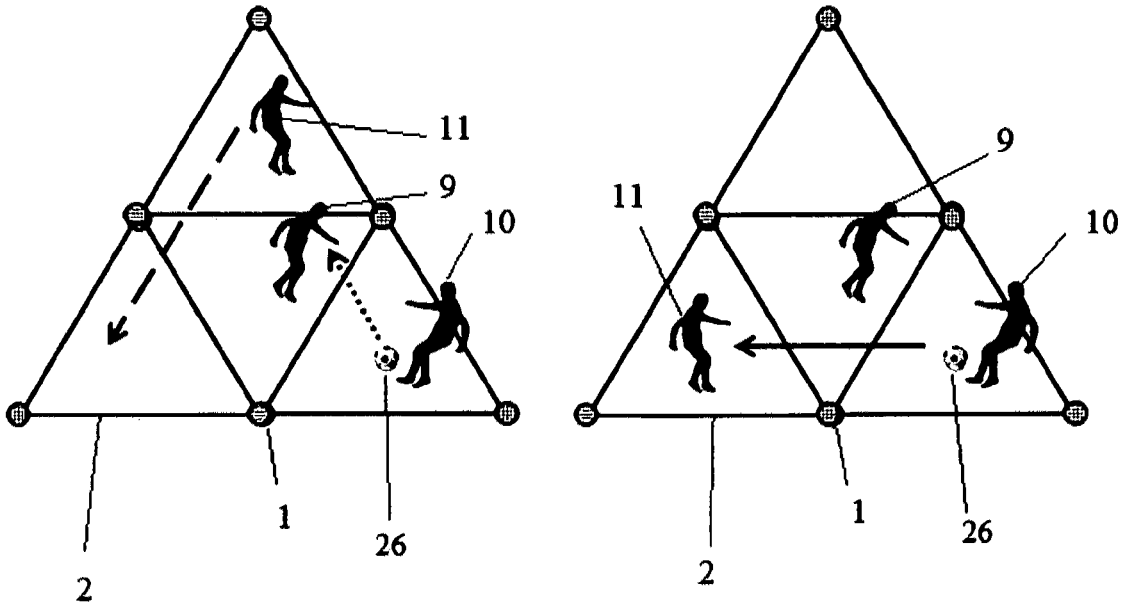
FIG. 4 illustrates one of the training benefits of the assembly and game demonstrated in FIG. 3.

The training benefits of this game are further described in FIG. 4, left. The attacker 10 with the ball cannot complete a pass to attacker 11 since the defender 9 is in the way and can intercept a pass (dotted line). Attacker 11 must move into the free outer triangle (as shown by the dashed line) in order to create room for the attacker 10 with the ball 26 to pass the ball without the defender 9 intercepting. Attacker 11 is encouraged to jump over the middle triangle, further reinforcing the notion of a preferred space for receiving a pass, see FIG. 4, right. The attacker 10 is now able to pass the ball 26 to the other attacker (who has jumped to the free outer triangle) since the defender 9 is no longer able to intercept the ball (solid line). One of the principal ideas of the device is that it clearly defines an efficient usage of space for moving the ball 26 between members of the same team using simple passes.

Figure 5:
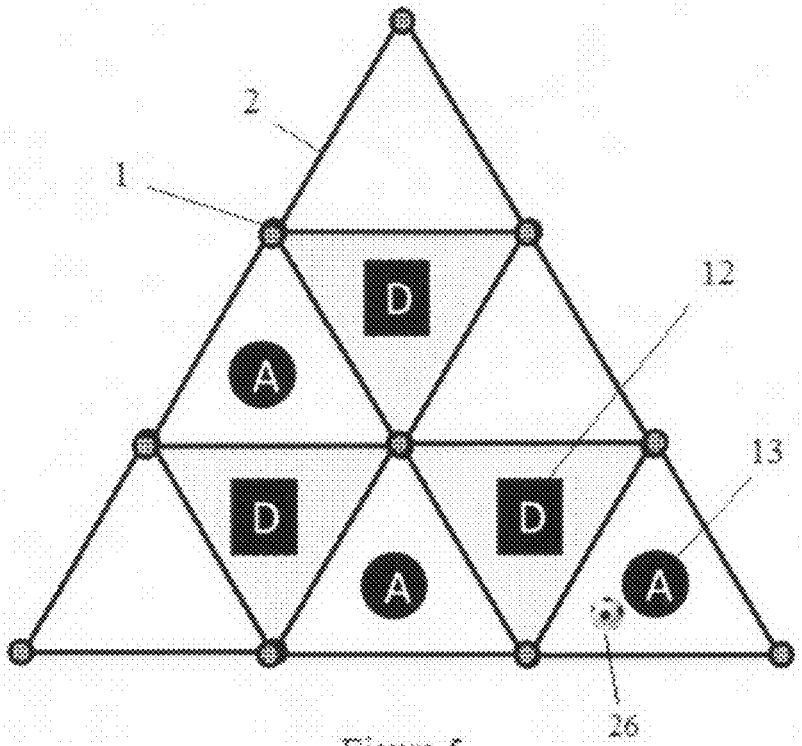
FIG. 5 shows an assembly of six basic triangles that form ten regions, and shows one method of usage.

FIG. 5 shows a variant on the game involving nine demarcated triangular regions, which can be constructed from six basic triangles. The inner three shaded triangles labeled D, for example see triangle 12, are defender triangles, the other six triangles, for example see triangle 13, are attacker triangles. Some number of players, typically up to three but perhaps more for oversized triangles, occupy the defender triangles, and some numbers of players occupy the attacker triangles. In the example shown there are three defenders D and three attackers A. The attacking players try to move the ball 26 from one corner to another and are awarded a point if successful. If the number of A and D players is the same, a competitive game can be defined in which the teams switch sides (A becomes D, D becomes A). The first team to achieve a predetermined score, or the team with the most points at the end of a predetermined interval, is declared winner.

Figure 6:
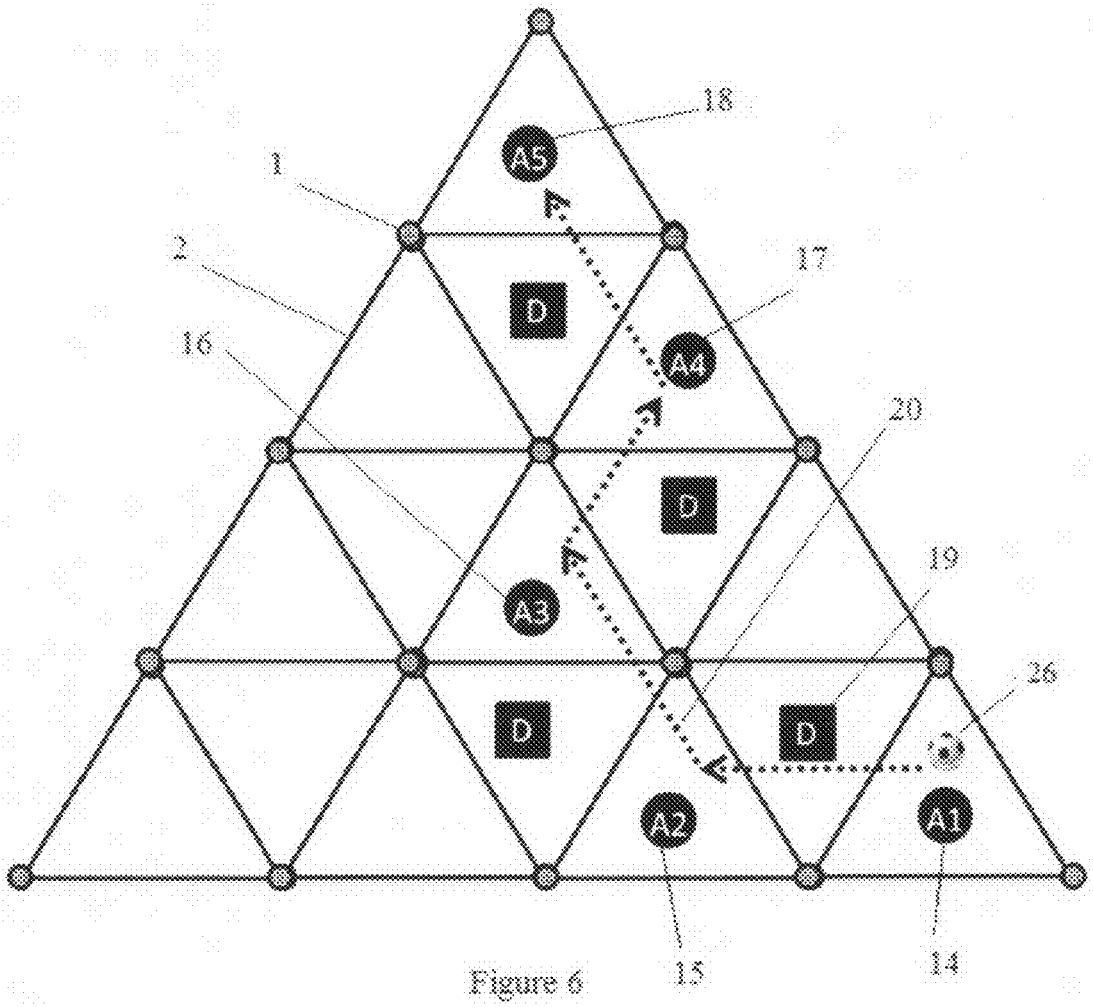
FIG. 6 shows an assembly of ten basic triangles demarcating sixteen regions and shows one method of usage.
Figure 7:
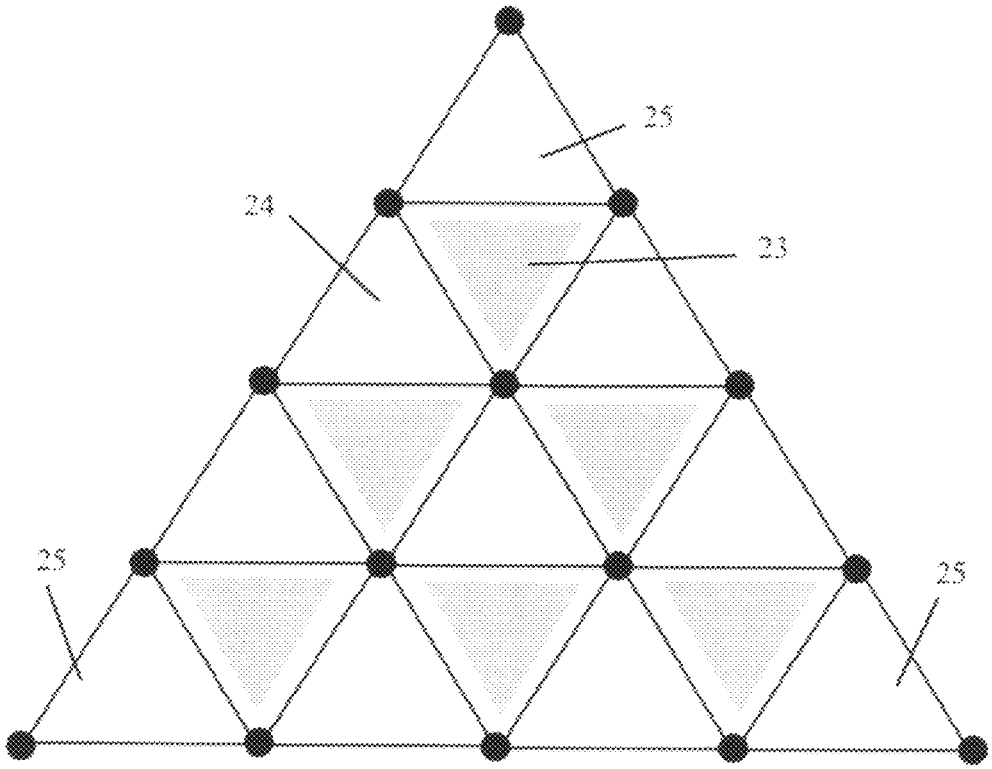
FIG. 7 shows an example of an arrangement of defender and attacker triangles that constrain player motion.

FIG. 6 shows a variant on the game involving 16 demarcated triangular regions, which can be constructed from 10 basic triangles (equivalently 15 vertices and 30 edges). In this game there are ten outer triangles for the attacking team, and six inner triangles for the defending team, as indicated in FIG. 7. The purpose is for the attacking team to pass the ball from one corner triangle to another by a sequence of passes. In the example in FIG. 6, a successful sequence of passes from player 14 in one corner triangle to player 18 in a different corner triangle is shown. The labeled circles A1 through A5 (players 14, 15, 16, 17, 18) are the attackers, the squares D (for example, see player 19) are defenders. The figure shows a successful sequence of passes from player 14 to player 15 to player 16 to player 17 to player 18, without a defender 19 (D) intercepting. The arrows 20 show an example path of the ball 26 movement. FIG. 7 shows the inner triangles gray colored 23 (defender triangles), the outer triangles white colored 24 (attacker triangles). Three of the outer triangles are corner triangles 25.

What is claimed:

1. A soccer training device comprising:

at least three outer boundary lines forming a polygon, said at least three outer boundary lines defining an enclosed training area for carrying out soccer drills;

said enclosed inner training area further divided into at least four inner polygons, each of said at least four inner polygons forming a distinct region adapted to accommodate at least one soccer player; and each of said at least four inner polygons further defined by at least three boundary lines, wherein each of said at least four inner polygons having at least one common boundary line with at least one other of the at least four inner polygons.

2. The soccer training device of claim 1, wherein said at least four inner polygons are triangles and wherein there is one center triangle and three outer triangles.

3. The soccer training device of claim 1, wherein said outer and inner boundary lines is selected from the group consisting of webbing, rope, mono-colored tape, bi-colored tape, pigment, tubing and optical projections.

4. The soccer training device of claim 1, wherein said at least four inner polygons is selected from the group consisting of nine (9) and sixteen (16) polygons.

5. A method of training a plurality of soccer players to improve skills in the sport of soccer comprising the steps of:

forming an enclosed training area by placing at least three outer boundary lines on a playing surface, said at least three outer boundary lines forming a polygon for carrying out soccer drills between the plurality of soccer players:

dividing said enclosed training area into at least four inner polygons, wherein each of said at least four inner polygons forming a distinct region for accommodating a soccer player;

enclosing each of said at least four inner polygons by at least three boundary lines, each of said at least four inner polygons having at least one common boundary line with at least one other of the at least four inner polygons, wherein said at least four polygons are a center triangle and three outer triangles;

positioning a soccer player (a defender) in said center triangle, wherein the defender may move within the center triangle;

positioning two soccer players (two attackers) in two of said three outer triangles, wherein said two attackers are free to move within the three outer triangles but are not allowed to move within the center triangle; and wherein the two attackers are not permitted in the same triangle simultaneously; and passing an object between said two attackers as the defender attempts to intercept the pass.

* * * * *